US010889764B2

(12) United States Patent
Kim et al.

(10) Patent No.: US 10,889,764 B2
(45) Date of Patent: Jan. 12, 2021

(54) METHOD FOR QUENCHING PYROLYSIS PRODUCT

(71) Applicant: LG CHEM, LTD., Seoul (KR)

(72) Inventors: In Seop Kim, Daejeon (KR); Seok Goo Lee, Daejeon (KR); Sung Kyu Lee, Daejeon (KR); Tae Woo Kim, Daejeon (KR); Joon Ho Shin, Daejeon (KR)

(73) Assignee: LG CHEM, LTD., Seoul (KR)

( * ) Notice: Subject to any disclaimer, the term of this patent is extended or adjusted under 35 U.S.C. 154(b) by 0 days.

(21) Appl. No.: 16/645,647

(22) PCT Filed: Jul. 2, 2019

(86) PCT No.: PCT/KR2019/007997
§ 371 (c)(1),
(2) Date: Mar. 9, 2020

(87) PCT Pub. No.: WO2020/040421
PCT Pub. Date: Feb. 27, 2020

(65) Prior Publication Data

US 2020/0263095 A1 Aug. 20, 2020

(30) Foreign Application Priority Data

Aug. 23, 2018 (KR) ..... 10-2018-0098337

(51) Int. Cl.
*C10G 9/00* (2006.01)
*C10G 51/06* (2006.01)
*C10G 70/06* (2006.01)

(52) U.S. Cl.
CPC ..... *C10G 9/002* (2013.01); *C10G 51/06* (2013.01); *C10G 70/06* (2013.01); *C10G 2300/1044* (2013.01); *C10G 2300/4012* (2013.01); *C10G 2400/20* (2013.01); *C10G 2400/28* (2013.01)

(58) Field of Classification Search
CPC ..... C10G 9/002; C10G 51/06; C10G 70/06
See application file for complete search history.

(56) References Cited

U.S. PATENT DOCUMENTS 3,928,173 A * 12/1975 James ..... C10G 51/026 208/78
4,143,521 A 3/1979 Pano et al.
(Continued)

FOREIGN PATENT DOCUMENTS

JP 61-176692 A 8/1986
KR 1998-081489 A 11/1998
(Continued)

OTHER PUBLICATIONS

Zimmerman et al., "Ethylene", Ullmann's Encyclopedia of Industrial Chemistry, vol. 13, pp. 465-529 (2012).

*Primary Examiner* — Renee Robinson
(74) *Attorney, Agent, or Firm* — Dentons US LLP

(57) ABSTRACT

A method for quenching a pyrolysis product, including: supplying a discharge stream from a liquid decomposition furnace to a first quench tower; supplying an upper discharge stream from the first quench tower to a second quench tower; supplying a discharge stream from a first gas decomposition furnace to the second quench tower; and supplying a discharge stream from a second gas decomposition furnace to the second quench tower.

9 Claims, 1 Drawing Sheet

(56) References Cited

U.S. PATENT DOCUMENTS

| | | | | |
|---|---|---|---|---|
| 2008/0146857 | A1* | 6/2008 | Verma | B01D 17/0211 165/60 |
| 2009/0280042 | A1 | 11/2009 | McCoy et al. | |
| 2015/0315484 | A1* | 11/2015 | Schmidt | C10G 9/36 585/652 |

FOREIGN PATENT DOCUMENTS

| | | | |
|---|---|---|---|
| KR | 10-2008-0055738 | A | 6/2008 |
| KR | 10-2010-0024474 | A | 3/2010 |
| KR | 10-2015-0038404 | A | 4/2015 |
| KR | 10-2015-0042210 | A | 4/2015 |
| KR | 10-2015-0042211 | A | 4/2015 |
| KR | 10-2016-0146677 | A | 12/2016 |

* cited by examiner

METHOD FOR QUENCHING PYROLYSIS PRODUCT

CROSS-REFERENCE TO RELATED APPLICATIONS

The application is the U.S. national stage of international application No. PCT/KR2019/007997, filed on Jul. 2, 2019, and claims the benefit of priority to Korean Patent Application No. 10-2018-0098337, filed on Aug. 23, 2018, the disclosures of which in their entirety are incorporated herein as part of the specification.

TECHNICAL FIELD

The present invention relates to a method for quenching a pyrolysis product, and more particularly, to a method of quenching a naphtha cracking product.

BACKGROUND

Naphtha is a fraction of gasoline obtained in a distillation apparatus of crude oil, and is used as a raw material for producing ethylene, propylene, benzene, and the like which are basic raw materials of petrochemistry by thermal decomposition. Preparation of a product by thermal decomposition of the naphtha is performed by introducing a hydrocarbon-based compound such as naphtha as a feedstock, thermally decomposing the hydrocarbon-based compound in a decomposition furnace, and quenching, compressing, and refining the thermally decomposed product.

Recently, in a thermal decomposition method using a hydrocarbon-based compound such as naphtha as a feedstock, a method in which a decomposition process of gas using ethane, propane, and the like as a feedstock is added, in addition to a decomposition process of a liquid using naphtha as a feedstock, in order to increase output of the product. Here, among the thermal decomposition products produced by decomposition of naphtha, ethane which is cycled after refinement is used as a feedstock, and among the thermal decomposition products produced by decomposition of naphtha, propane which is cycled after refinement and the like are used as a feedstock, or propane which is introduced from the outside is used as a feedstock. In particular, since the cost of propane is lower than the cost of other feedstocks, it is easy to supply propane from the outside, and the cost of production thereof is reduced due to its low cost.

Meanwhile, for a thermal decomposition process of naphtha, when a gas decomposition process using ethane, propane, and the like is added, it is preferred to add processes for quenching, compressing, and refining the product produced as a result of thermal decomposition as well; however, only the decomposition furnace is mainly added for the reasons of a space problem to add the processes or reducing investment costs, and the decomposition furnace is added by connecting it to the existing equipment.

Here, in the case in which the decomposition furnace is added as described above, and propane and the like are further introduced from the outside as a feedstock to the decomposition furnace, a capacity of a thermal decomposition product supplied to a quench tower is increased by the decomposition furnace added. However, since the quench tower has a limited capacity for quenching the pyrolysis product, the thermal decomposition product supplied in excess of the limited capacity of the quench tower leads to an increase in a differential pressure from an outlet of a decomposition furnace to an inlet of a compressor, which increases the pressure at the outlet of the decomposition furnace to lower a selectivity of a thermal decomposition reaction and to cause a product yield to be lowered. In addition, the thermal decomposition product supplied in excess of the limited capacity of the quench tower has a problem of lowering separation efficiency of the quench tower.

In addition, when the pressure at the inlet of the compressor is increased, density is increased so that more streams may be transported to the same compressor. That is, since the compressor transports the same volume of stream, the mass of stream is increased under higher pressure. Accordingly, generally in the thermal decomposition process of naphtha, the pressure at the inlet of the compressor is adjusted for increasing output at the time of compressing and refining.

In this connection, the pressure at the outlet of the decomposition furnace is determined by adding the differential pressure from the outlet of the decomposition furnace to the inlet of the compressor to the pressure at the inlet of the compressor. However, as the pressure at the outlet of the decomposition furnace is increased, the selectivity of the thermal decomposition reaction is decreased to lower the product yield and to increase a coke production amount, and thus, there is a limitation on maintaining the pressure at the outlet of the decomposition furnace at or below a certain level, and accordingly, there is also a limitation on increasing the pressure of the inlet of the compressor.

SUMMARY

In order to solve the problems mentioned above in the Background Art, an object of the present invention is to improve process stability and separation efficiency of a quench tower following addition of a feedstock, and further, to improve a differential pressure from an outlet of a decomposition furnace to an inlet of a compressor, at the time of preparing a product by thermal decomposition of naphtha.

That is, an object of the present invention is to provide a method for quenching a pyrolysis product, in which at the time of preparing a product by thermal decomposition of naphtha, in spite of an increased capacity of the thermal decomposition product due to addition of a feedstock, it is possible to cool a thermal decomposition product within a limited capacity of a quench tower, whereby increased differential pressure from an outlet of a decomposition furnace to an inlet of a compressor is improved, so that process stability and further separation efficiency of the quench tower are improved, and even in the case in which the pressure at the inlet of the compressor is further increased, from the improved differential pressure, pressure at the outlet of the decomposition furnace may be maintained at or below a certain level, so that output of the product by thermal decomposition of naphtha is increased.

In one general aspect, a method for quenching a pyrolysis product includes: supplying a discharge stream from a liquid decomposition furnace to a first quench tower; supplying an upper discharge stream from the first quench tower to a second quench tower; supplying a discharge stream from a first gas decomposition furnace to the second quench tower; and supplying a discharge stream from a second gas decomposition furnace to the second quench tower.

When the method for quenching a pyrolysis product according to the present invention is used, there are effects that at the time of preparing a product by thermal decomposition of naphtha, in spite of an increased capacity of the thermal decomposition product due to addition of a feedstock, it is possible to cool a thermal decomposition product within a limited capacity of a quench tower, whereby increased differential pressure from an outlet of a decomposition furnace to an inlet of a compressor is improved, so that process stability and also separation efficiency of the quench tower are improved, and even in the case in which the pressure at the inlet of the compressor is further increased, from the improved differential pressure, pressure at the outlet of the decomposition furnace may be maintained at or below a certain level, so that output of the product by thermal decomposition of naphtha is increased.

DETAILED DESCRIPTION

Figure 1:
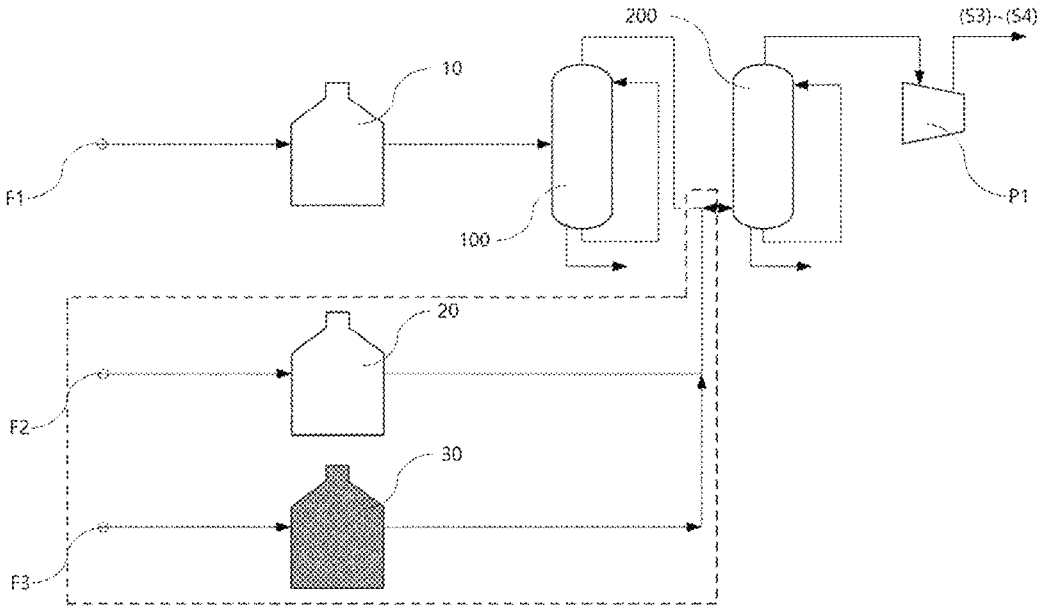
FIG. 1 is a flowchart of a method for quenching a pyrolysis product according to an exemplary embodiment of this application.

The terms and words used in the description and claims of the present invention are not to be construed as general or dictionary meanings but are to be construed as meanings and concepts meeting the technical ideas of the present invention based on a principle that the inventors can appropriately define the concepts of terms in order to describe their own inventions in the best mode.

In the present invention, the term, "stream" may refer to a fluid flow in the process, or may refer to the fluid itself flowing in a pipe. Specifically, the "stream" may refer to both the fluid itself flowing and the fluid flow, in pipes connecting each apparatus. In addition, the fluid may refer to a gas or a liquid.

In the present invention, the term, "differential pressure" may refer to a difference between a pressure at an outlet of a decomposition furnace and a pressure at an inlet of a compressor, and as a specific example, the differential pressure may be calculated by the following Equation 1:

$$\text{Differential pressure} = \text{pressure at outlet of decomposition furnace} - \text{pressure at inlet of compressor} \quad \text{[Equation 1]}$$

Hereinafter, the present invention will be described in more detail for understanding the present invention.

The method for quenching a pyrolysis product according to the present invention may include: supplying a discharge stream from a liquid decomposition furnace 10 to a first quench tower 100; supplying an upper discharge stream from the first quench tower 100 to a second quench tower 200; supplying a discharge stream from a first gas decomposition furnace 20 to the second quench tower 200; and supplying a discharge stream from a second gas decomposition furnace 30 to the second quench tower 200.

According to an exemplary embodiment of the present invention, a method of preparing a thermal decomposition product to obtain the thermal decomposition product from a feedstock may be performed by including introducing naphtha and the like to feedstocks F1, F2, and F3 and performing thermal decomposition in a plurality of decomposition furnaces 10, 20, and 30 (S1); quenching the pyrolysis product which has been thermally decomposed in each of the decomposition furnaces 10, 20, and 30 (S2); compressing the cooled thermal decomposition product (S3); and refining and separating the compressed thermal decomposition product (S4).

Specifically, in the thermal decomposition step (S1), when thermal decomposition is performed by a gas decomposition process using a hydrocarbon compound having 2 to 4 carbon atoms as a feedstock F3, there is an effect that supply from the outside is easy due to its low cost and output of the thermal decomposition product is increased while reducing a production cost, as compared with the case of using other feedstocks F1 and F2, for example, the existing naphtha F1 and recycled C2 and C3 hydrocarbon compounds are used as a feedstock F2.

However, when a hydrocarbon compound having 2 to 4 carbon atoms is added as a feedstock F3, a capacity of the thermal decomposition product is increased to lower process stability of a quenching step (S2) and to lower separation efficiency of a quench tower for performing the quenching step (S2).

Figure 2:
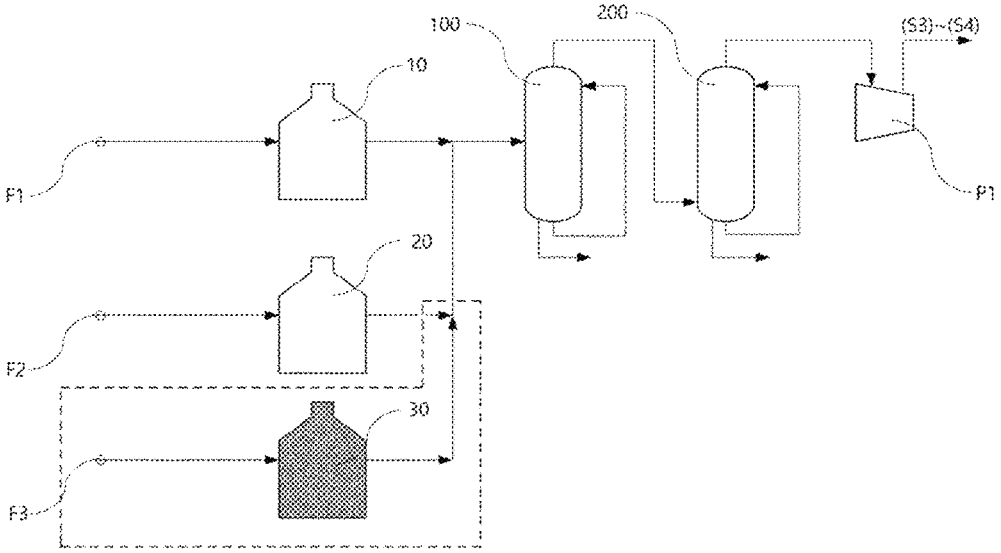
FIG. 2 is a flowchart of a method for quenching a pyrolysis product according to a comparative embodiment of this application.

Specifically, as shown in FIG. 2, when the thermal decomposition products produced in a plurality of decomposition furnaces 10, 20, and 30 are supplied to the first quench tower 100 all together, the limited capacity of the first quench tower 100 is exceeded due to the increased capacity of the thermal decomposition products. Accordingly, differential pressure from the outlets of the plurality of decomposition furnaces 10, 20, and 30 to the inlet of a compressor P1 is increased, resulting in lowering the process stability from the decomposition furnaces 10, 20, and 30 to the compressor P1. In addition, the thermal decomposition product supplied in excess of the limited capacity of the first quench tower 100 has a problem of lowering the separation efficiency of the first quench tower 100.

However, according to the method for quenching a pyrolysis product of the present invention, when in a plurality of decomposition furnaces, the discharge stream from the liquid decomposition furnace 10 is supplied to the first quench tower 100, and the discharge stream from the first gas decomposition furnace 20 and the discharge stream from the second gas decomposition furnace 30 are directly supplied to the second quench tower 200, there are effects that in spite of the increased capacity of the thermal decomposition product by addition of the feedstock F3, it is possible to cool the thermal decomposition product within the limited capacity of the first quench tower 100, whereby increased differential pressure from the outlets of the decomposition furnaces 10, 20, and 30 to the inlet of the compressor P1 is improved, so that process stability and also separation efficiency of the first quench tower 100 are improved, and even in the case in which the pressure at the inlet of the compressor P1 is further increased, from the improved differential pressure, the pressures at the outlets of the decomposition furnaces 10, 20, and 30 are maintained at or below a certain level, so that the output of the product by the thermal decomposition of naphtha is increased.

That is, the method for quenching a pyrolysis product according to an exemplary embodiment of the present invention may be applied to a quenching step (S2) of the method of preparing a thermal decomposition product.

According to an exemplary embodiment of the present invention, the liquid decomposition furnace 10 may be a decomposition furnace for thermally decomposing a feedstock F1 supplied to a liquid phase. Here, a thermal decomposition temperature of the liquid decomposition furnace 10 may be 500° C. to 1,000° C., 750° C. to 875° C., or 800° C. to 850° C., and within the range, there is an effect that the thermal decomposition yield of the feedstock F1 supplied to the liquid decomposition furnace 10 is excellent.

In addition, according to an exemplary embodiment of the present invention, the feedstock F1 for performing liquid thermal decomposition in the liquid decomposition furnace 10 may include a mixture of hydrocarbon compounds supplied in the form of a liquid phase. As a specific example, the feedstock F1 may include naphtha. As a more specific example, the feedstock F1 may be naphtha. The naphtha may be derived from a fraction of gasoline obtained in a distillation apparatus of crude oil.

According to an exemplary embodiment of the present invention, the first gas decomposition furnace 20 may be a decomposition furnace for thermally decomposing a feedstock F2 supplied to a gas phase. Here, a thermal decomposition temperature of the first gas decomposition furnace 20 may be 500° C. to 1,000° C., 750° C. to 900° C., or 825° C. to 875° C., and within the range, there is an effect that the thermal decomposition yield of the feedstock F2 supplied to the first gas decomposition furnace 20 is excellent.

In addition, according to an exemplary embodiment of the present invention, the feedstock F2 for performing gas thermal decomposition in the first gas decomposition furnace 20 may include a mixture of hydrocarbon compounds supplied in the form of a gas phase. As a specific example, the feedstock F2 may include one or more selected from the group consisting of recycled C2 hydrocarbon compounds and recycled C3 hydrocarbon compounds. As a more specific example, the feedstock F2 may be one or more selected from the group consisting of recycled C2 hydrocarbon compounds and recycled C3 hydrocarbon compounds. The recycled C2 hydrocarbon compound and the recycled C3 hydrocarbon compound may be derived from the C2 hydrocarbon compound and the C3 hydrocarbon compound which are refined and recycled in the refinement step (S4), respectively.

In addition, according to an exemplary embodiment of the present invention, the recycled C2 hydrocarbon compound may be ethane which is refined and then recycled in the refinement step (S4), and the recycled C3 hydrocarbon compound may be propane which is refined and then recycled in the refinement step (S4).

According to an exemplary embodiment of the present invention, the second gas decomposition furnace 30 may be a decomposition furnace for thermally decomposing a feedstock F3 supplied to a gas phase. Here, a thermal decomposition temperature of the second gas decomposition furnace 30 may be adjusted depending on the feedstock F3, and may be specifically 500° C. to 1,000° C., 750° C. to 875° C., or 825° C. to 875° C., and within the range, there is an effect that the thermal decomposition yield of the feedstock F3 supplied to the second gas decomposition furnace 30 is excellent.

In addition, according to an exemplary embodiment of the present invention, the feedstock F3 for performing gas thermal decomposition in the second gas decomposition furnace 30 may include a mixture of hydrocarbon compounds supplied in the form of a gas phase. As a specific example, the feedstock F3 may include a hydrocarbon compound having 2 to 4, or 2 or 3 carbon atoms. As a more specific example, the feedstock F3 may be one or more selected from the group consisting of propane and butane.

In addition, according to an exemplary embodiment of the present invention, the feedstock F3 for performing the gas thermal decomposition in the second gas decomposition furnace 30 may be derived from liquefied petroleum gas (LPG) including one or more selected from the group consisting of propane and butane, and the liquefied petroleum gas may be vaporized for supply to the second gas decomposition furnace 30 and supplied to the second gas decomposition furnace 30.

According to an exemplary embodiment of the present invention, the first quench tower 100 may be a quench tower for quenching the discharge stream from the liquid decomposition furnace. Specifically, the first quench tower 100 may be a quench oil tower. The first quench tower 100 uses oil as a coolant for quenching the pyrolysis product, and the oil may be used by cycling a heavy hydrocarbon compound having 9 to 20 carbon atoms having a boiling point of 200° C. or higher which is produced in the thermal decomposition product.

According to an exemplary embodiment of the present invention, the first quench tower 100 may cool the thermal decomposition product and also separate the heavy hydrocarbon compound having 9 or more carbon atoms in the thermal decomposition product. Accordingly, the discharge stream from the liquid decomposition furnace 10 supplied to the first quench tower 100 may be separated into a hydrocarbon compound having 8 or less carbon atoms and a hydrocarbon compound having 9 or more carbon atoms in the first quench tower 100. Specifically, the upper discharge stream from the first quench tower 100 may include a hydrocarbon compound having 8 or less carbon atoms, and the lower discharge stream from the first quench tower 100 may include a hydrocarbon compound having 9 or more carbon atoms.

According to an exemplary embodiment of the present invention, the second quench tower 200 may be a quench tower for quenching the upper discharge stream from the first quench tower 100, the discharge stream from the first gas decomposition furnace, and the discharge stream from the second gas decomposition furnace. Specifically, the second quench tower 200 may be a quench water tower. The second quench tower 200 uses water as a coolant for quenching the pyrolysis product, and the water may be used by cycling water produced by condensing dilution steam which is introduced for increasing thermal decomposition efficiency at the time of the thermal decomposition reaction.

According to an exemplary embodiment of the present invention, the second quench tower 200 may cool the thermal decomposition product and also separate a hydrocarbon compound having 6 to 8 carbon atoms in the thermal decomposition product. Accordingly, the upper discharge stream from the first quench tower 100, the discharge stream from the first gas decomposition furnace, and the discharge stream from the second gas decomposition furnace, which are supplied to the second quench tower 200, may be separated into a hydrocarbon compound having 5 or less carbon atoms and a hydrocarbon compound having 6 to 8 carbon atoms in the second quench tower 200.

According to an exemplary embodiment of the present invention, the discharge stream from the first gas decomposition furnace 20 and the discharge stream from the second gas decomposition furnace 30, which are supplied to the second quench tower 200, may join the upper discharge stream from the first quench tower 100 and be supplied to the second quench tower 200. That is, the discharge stream from the first gas decomposition furnace 20 and the discharge stream from the second gas decomposition furnace 30 may be supplied to the second quench tower 200 through an inlet of the second quench tower 200 which is the same as the upper discharge stream from the first quench tower 100.

In addition, according to an exemplary embodiment of the present invention, the discharge stream from the second gas decomposition furnace 30 may join the discharge stream from the first gas decomposition furnace 20, before joining the upper discharge stream from the first quench tower 100, and join the upper discharge stream from the first quench tower 100.

Meanwhile, according to an exemplary embodiment of the present invention, the discharge stream from the first gas decomposition furnace 20 and the discharge stream from the second gas decomposition furnace 30 which are discharged by thermal decomposition in the first gas decomposition furnace 20 and the second gas decomposition furnace 30, may include an extremely small amount of or not include the heavy hydrocarbon compound having 9 or more carbon atoms in the thermal decomposition product, according to the characteristics of the feedstocks F2 and F3. Accordingly, since the discharge stream from the first gas decomposition furnace 20 and the discharge stream from the second gas decomposition furnace 30 are not essentially required to be subjected to a process of separating the heavy hydrocarbon compound having 9 or more carbon atoms in the thermal decomposition product simultaneously with quenching, it is possible to supply the discharge streams directly to the second quench tower instead of subjecting the discharge streams to quenching and separating processes in the first quench tower 100, by the method for quenching a pyrolysis product according to the present invention.

As such, when the discharge stream from the first gas decomposition furnace 20 and the discharge stream from the second gas decomposition furnace 30 are supplied to the second quench tower 200, only the discharge stream from the liquid decomposition furnace 10 is supplied to the first quench tower 100 and cooled. Accordingly, there are effects that even in the case in which the output of the thermal decomposition product is increased due to the increased supply amounts of the feedstocks F2 and F3 supplied to the gas decomposition furnaces 20 and 30, only the discharge stream from the liquid decomposition furnace 10 is supplied to the first quench tower 100, and thus, it is possible to cool the thermal decomposition product within the limited capacity of the first quench tower 100, whereby increased differential pressure from the outlets of the decomposition furnaces 10, 20, and 30 to the inlet of the compressor P1 is improved, so that process stability and also separation efficiency of the first quench tower 100 are improved, and even in the case that the pressure at the inlet of the compressor P1 is further increased, from the improved differential pressure, the pressures at the outlets of the decomposition furnaces 10, 20, and 30 are maintained at or below a certain level, so that the output of the product by thermal decomposition of naphtha is increased.

According to an exemplary embodiment of the present invention, the pressure of the discharge stream from the liquid decomposition furnace 10 at the outlet of the liquid decomposition furnace 10 may be 1.5 bar(a) to 2.0 bar(a), 1.6 bar(a) to 1.9 bar(a), or 1.73 bar(a) to 1.78 bar(a).

In addition, according to an exemplary embodiment of the present invention, the pressure of the discharge stream from the first gas decomposition furnace 20 at the outlet of the first gas decomposition furnace 20 may be 1.5 bar(a) to 2.5 bar(a), 1.6 bar(a) to 2.0 bar(a), or 1.70 bar(a) to 1.75 bar(a).

In addition, according to an exemplary embodiment of the present invention, the pressure of the discharge stream from the second gas decomposition furnace 30 at the outlet of the second gas decomposition furnace 30 may be 1.5 bar(a) to 2.5 bar(a), 1.6 bar(a) to 2.0 bar(a), or 1.70 bar(a) to 1.75 bar(a).

According to an exemplary embodiment of the present invention, within the pressure range, there is an effect that the differential pressure from the outlets of the decomposition furnaces 10, 20, and 30 to the inlet of the compressor P1 is maintained at a level which is preferred for quenching the pyrolysis product, and thus, process stability is excellent. In addition, there is an effect that even in the case in which the pressure at the inlet of the compressor P1 is further increased, from the improved differential pressure, the pressures at the outlets of the decomposition furnaces 10, 20, and 30 are maintained at or below a certain level, so that the output of the product by thermal decomposition of naphtha is increased.

In addition, according to an exemplary embodiment of the present invention, the upper discharge stream from the second quench tower 200 may be supplied to the compressor P1. The compressor P1 may be a compressor P1 for performing the compression step (S3). When the compression step (S3) is performed by multi-stage compression, the compressor P1 may be a first compressor of the multi-stage compressor.

According to an exemplary embodiment of the present invention, the compression step (S3) may include a compression process in which compression is performed by multi-stage compression from two or more compressors for refining the thermal decomposition stream which has been cooled in the quenching step (S2). In addition, the thermal decomposition product which has been compressed by the compression step (S3) may be refined and separated by the refinement step (S4).

According to an exemplary embodiment of the present invention, the pressure of the upper discharge stream from the second quench tower 200 at the inlet of the compressor P1 may be 1.1 bar(a) to 2.0 bar(a), 1.1 bar(a) to 1.8 bar(a), or 1.1 bar(a) to 1.5 bar(a).

According to an exemplary embodiment of the present invention, within the pressure range, there is an effect that the differential pressure from the outlets of the decomposition furnaces 10, 20, and 30 to the inlet of the compressor P1 is maintained at a level which is preferred for quenching the pyrolysis product, and thus, process stability is excellent.

In addition, as described above, when the pressure at the inlet of the compressor is increased, density is increased so that more streams may be transported to the same compressor. That is, since the compressor transports the same volume of stream, the mass of stream is increased under higher pressure. Accordingly, generally in the thermal decomposition process of naphtha, the pressure at the inlet of the compressor is adjusted for increasing output at the time of compressing and refining.

In addition, in this connection, the pressure at the outlet of the decomposition furnace is determined by adding the differential pressure from the outlet of the decomposition furnace to the inlet of the compressor to the pressure at the inlet of the compressor. However, as the pressure at the outlet of the decomposition furnace is increased, the selectivity of the thermal decomposition reaction is decreased to lower the product yield and to increase a coke production amount, and thus, there is a limitation on maintaining the pressure at the outlet of the decomposition furnace at or below a certain level, and accordingly, there is also a limitation on increasing the pressure of the inlet of the compressor.

However, according to the present invention, there are effects that the differential pressure is improved within the pressure range, and thus, even in the case in which the pressure at the inlet of the compressor P1 is further increased, the pressures at the outlets of the decomposition furnaces 10, 20, and 30 are maintained at or below a certain level, so that the output of the product by thermal decomposition of naphtha is increased.

In addition, according to an exemplary embodiment of the present invention, the differential pressure between the pressure of each discharge stream from the decomposition furnaces 10, 20, and 30 at the outlets of the decomposition furnaces 10, 20, and 30 and the pressure of the upper discharge stream from the second quench tower 200 at the inlet of the compressor P1 (=pressure at the outlet of the decomposition furnace−pressure at the inlet of the compressor) may be 0.28 bar or less, 0.1 bar to 0.28 bar, or 0.1 bar to 0.23 bar.

Within the range, there is an effect that even in the case in which the output of the thermal decomposition product is increased due to the increased supply amounts of the feedstocks F2 and F3 supplied to the gas decomposition furnaces 20 and 30, the differential pressure is maintained at a level which is preferred for quenching the pyrolysis product, and thus, process stability is excellent. Furthermore, there is an effect that even in the case in which the pressure at the inlet of the compressor P1 is further increased, from the improved differential pressure, the pressures at the outlets of the decomposition furnaces 10, 20, and 30 are maintained at or below a certain level, so that the output of the product by thermal decomposition of naphtha is increased.

As a specific example, the differential pressure between the pressure of the discharge stream from the liquid decomposition furnace 10 at the outlet of the liquid decomposition furnace and the pressure of the upper discharge stream from the second quench tower at the inlet of the compressor may be 0.28 bar or less, 0.1 bar to 0.28 bar, or 0.1 bar to 0.23 bar.

In addition, as a specific example, the differential pressure between the pressure of the discharge stream from the first gas decomposition furnace 20 at the outlet of the first gas decomposition furnace and the pressure of the upper discharge stream from the second quench tower at the inlet of the compressor may be 0.26 bar or less, 0.1 bar to 0.25 bar, or 0.1 bar to 0.20 bar.

In addition, as a specific example, the differential pressure between the pressure of the discharge stream from the second gas decomposition furnace 30 at the outlet of the second gas decomposition furnace and the pressure of the upper discharge stream from the second quench tower at the inlet of the compressor may be 0.26 bar or less, 0.1 bar to 0.25 bar, or 0.1 bar to 0.20 bar.

Hereinafter, the present invention will be described in more detail by the Examples. However, the following Examples are provided for illustrating the present invention. It is apparent to a person skilled in the art that various modifications and alterations may be made without departing from the scope and spirit of the present invention, and the scope of the present invention is not limited thereto.

EXPERIMENTAL EXAMPLES

Example 1

For the flowchart illustrated in FIG. 1, the process was simulated using an Aspen Plus simulator available from Aspen Technology, Inc., and the pressures at the positions of each stream are shown in Table 1. The pressure is represented as an absolute pressure (bar(a)) obtained by adding atmospheric pressure to gauge pressure (bar(g)).

Here, naphtha F1, a recycled hydrocarbon compound F2, and propane F3 were used as feedstocks, and each of the feedstocks F1, F2, and F3 were supplied to the liquid decomposition furnace 10, the first gas decomposition furnace 20, and the second gas decomposition furnace 30, at flow rates of 232,000 kg/hr (F1), 45,500 kg/hr (F2), and 116,000 kg/hr (F3), respectively.

TABLE 1

| Classification | | |
|---|---|---|
| Stream | Position | Pressure (bar(a)) |
| Discharge stream from liquid decomposition furnace 10 | Outlet of liquid decomposition furnace 10 | 1.73 |
| | Inlet of first quench tower 100 | 1.72 |
| Upper discharge stream from first quench tower 100 | Upper outlet of first quench tower 100 | 1.70 |
| | Inlet of second quench tower 200 | 1.58 |
| Discharge stream from first gas decomposition furnace 20 | Outlet of first gas decomposition furnace 20 | 1.70 |
| | Inlet of second quench tower 200 | 1.58 |
| Discharge stream from second gas decomposition furnace 30 | Outlet of second gas decomposition furnace 30 | 1.70 |
| | Inlet of second quench tower 200 | 1.58 |
| Upper discharge stream from second quench tower 200 | Upper outlet of second quench tower 200 | 1.55 |
| | Inlet of compressor | 1.50 |

Comparative Example 1

The process was simulated under the same conditions as Example 1, except that the flowchart illustrated in FIG. 2 was used instead of the flowchart illustrated in FIG. 1, and the pressures at the positions of each stream are shown in the following Table 2.

TABLE 2

| Classification | | |
|---|---|---|
| Stream | Position | Pressure (bar(a)) |
| Discharge stream from liquid decomposition furnace 10 | Outlet of liquid decomposition furnace 10 | 1.78 |
| | Inlet of first quench tower 100 | 1.75 |
| Discharge stream from first gas decomposition furnace 20 | Outlet of first gas decomposition furnace 20 | 1.78 |
| | Inlet of first quench tower 100 | 1.75 |
| Discharge stream from second gas decomposition furnace 30 | Outlet of second gas decomposition furnace 30 | 1.78 |
| | Inlet of first quench tower 100 | 1.75 |
| Upper discharge stream from first quench tower 100 | Upper outlet of first quench tower 100 | 1.69 |
| | Inlet of second quench tower 200 | 1.58 |
| Upper discharge stream from second quench tower 200 | Upper outlet of second quench tower 200 | 1.55 |
| | Inlet of compressor | 1.50 |

As shown in the above Tables 1 and 2, it was confirmed that when the thermal decomposition products for each decomposition furnace were all supplied to the first quench tower according to Comparative Example 1 (FIG. 2), the differential pressure between the pressures of the discharge streams from each decomposition furnace at the outlet of the decomposition furnace and at the inlet of the compressor was shown to be 0.28 bar, which is high; however, when the thermal decomposition products for each decomposition furnace were separately supplied to the first quench tower or the second quench tower according to Example 1 (FIG. 1) of the present invention, the differential pressure between the pressures of the discharge streams from each decomposition furnace at the outlet of the decomposition furnace and at the inlet of the compressor was maintained between 0.20 bar to 0.23 bar.

Example 2

For the flowchart illustrated in FIG. 1, the process was simulated using the Aspen Plus simulator available from Aspen Technology, Inc., and the pressures at the positions of each stream are shown in Table 3. The pressure is represented as an absolute pressure (bar(a)) obtained by adding atmospheric pressure to gauge pressure (bar(g)).

Here, naphtha F1, a recycled hydrocarbon compound F2, and propane F3 were used as feedstocks, and each of the feedstocks F1, F2, and F3 was supplied to the liquid decomposition furnace 10, the first gas decomposition furnace 20, and the second gas decomposition furnace 30, at flow rates of 255,000 kg/hr (F1), 52,000 kg/hr (F2), and 135,000 kg/hr (F3), respectively.

TABLE 3

| Classification | | |
|---|---|---|
| Stream | Position | Pressure (bar(a)) |
| Discharge stream from liquid decomposition furnace 10 | Outlet of liquid decomposition furnace 10 | 1.78 |
| | Inlet of first quench tower 100 | 1.77 |
| Upper discharge stream from first quench tower 100 | Upper outlet of first quench tower 100 | 1.76 |
| | Inlet of second quench tower 200 | 1.60 |
| Discharge stream from first gas decomposition furnace 20 | Outlet of first gas decomposition furnace 20 | 1.75 |
| | Inlet of second quench tower 200 | 1.60 |
| Discharge stream from second gas decomposition furnace 30 | Outlet of second gas decomposition furnace 30 | 1.75 |
| | Inlet of second quench tower 200 | 1.60 |
| Upper discharge stream from second quench tower 200 | Upper outlet of second quench tower 200 | 1.56 |
| | Inlet of compressor | 1.50 |

Comparative Example 2

The process was simulated under the same conditions as Example 2, except that the flowchart illustrated in FIG. 2 was used instead of the flowchart illustrated in FIG. 1, and the pressure of each stream at each position is shown in the following Table 4.

TABLE 4

| Classification | | |
|---|---|---|
| Stream | Position | Pressure (bar(a)) |
| Discharge stream from liquid decomposition furnace 10 | Outlet of liquid decomposition furnace 10 | 1.85 |
| | Inlet of first quench tower 100 | 1.82 |
| Discharge stream from first gas decomposition furnace 20 | Outlet of first gas decomposition furnace 20 | 1.85 |
| | Inlet of first quench tower 100 | 1.85 |
| Discharge stream from second gas decomposition furnace 30 | Outlet of second gas decomposition furnace 30 | 1.85 |
| | Inlet of first quench tower 100 | 1.82 |
| Upper discharge stream from first quench tower 100 | Upper outlet of first quench tower 100 | 1.74 |
| | Inlet of second quench tower 200 | 1.60 |
| Upper discharge stream from second quench tower 200 | Upper outlet of second quench tower 200 | 1.56 |
| | Inlet of compressor | 1.50 |

As shown in the above Tables 3 and 4, it was confirmed that when the thermal decomposition products for each decomposition furnace were all supplied to the first quench tower according to Comparative Example 2 (FIG. 2), the differential pressure between the pressures of the discharge streams from each decomposition furnace at the outlet of the decomposition furnace and at the inlet of the compressor was shown to be 0.35 bar, which is high; however, when the thermal decomposition products for each decomposition furnace were separately supplied to the first quench tower or the second quench tower according to Example 2 (FIG. 1) of the present invention, the differential pressure between the pressures of the discharge streams from each decomposition furnace at the outlet of the decomposition furnace and at the inlet of the compressor was maintained between 0.25 bar to 0.28 bar.

In particular, in Example 2, by increasing flow rates of the feedstocks F1, F2, and F3 for each of the decomposition furnace 10, 20, and 30 in Example 1, the differential pressure between the pressure at the outlet of each decomposition furnace and the pressure at the inlet of the compressor was somewhat increased as compared with the differential pressure of Example 1, but it was confirmed that the output of ethylene which is the product by the thermal decomposition of naphtha was increased by 10% or more as compared with Example 1.

However, in Comparative Example 2 in which the feedstocks were supplied at the same flow rate under the same conditions as Example 2, it was confirmed that the differential pressure between the pressure at the outlet of each decomposition furnace and the pressure at the inlet of the compressor was excessively increased, whereby selectivity was lowered at the time of the decomposition reaction in each decomposition furnace, and thus, the output of the product by the thermal decomposition of naphtha was reduced, so that normal operation was impossible.

The present inventors confirmed from the above results that when the method for quenching a pyrolysis product according to the present invention is used, at the time of preparing a product by thermal decomposition of naphtha, in spite of the increased capacity of the thermal decomposition product due to the addition of the feedstock, it was possible to cool the thermal decomposition product within the limited capacity of the quench tower, whereby the increased differential pressure from the outlet of the decomposition furnace to the inlet of the compressor was improved, so that process stability and also separation efficiency of the quench tower are improved.

The invention claimed is:

1. A method for quenching a pyrolysis product, the method comprising: supplying a discharge stream from a liquid decomposition furnace to a first quench tower;

supplying an upper discharge stream from the first quench tower to a second quench tower;

supplying a discharge stream from a first gas decomposition furnace to the second quench tower; and supplying a discharge stream from a second gas decomposition furnace to the second quench tower, wherein the discharge stream from the first gas decomposition furnace and the discharge stream from the second gas decomposition furnace join the upper discharge stream from the first quench tower, respectively, and are supplied together to the second quench tower.

2. The method of claim 1, wherein a feedstock supplied to the liquid decomposition furnace includes naphtha.

3. The method of claim 1, wherein a feedstock supplied to the first gas decomposition furnace includes one or more selected from the group consisting of recycled C2 hydrocarbon compounds and recycled C3 hydrocarbon compounds.

4. The method of claim 1, wherein a feedstock supplied to the second gas decomposition furnace includes hydrocarbon compounds having 2 to 4 carbon atoms.

5. The method of claim 4, wherein the feedstock supplied to the second gas decomposition furnace is one or more selected from the group consisting of propane and butane.

6. The method of claim 1, wherein an upper discharge stream from the second quench tower is supplied to a compressor.

7. The method of claim 6, wherein a differential pressure between a pressure of the discharge stream from the liquid decomposition furnace at the outlet of the liquid decomposition furnace and a pressure of the upper discharge stream from the second quench tower at the inlet of the compressor is 0.28 bar or less.

8. The method of claim 6, wherein a differential pressure between a pressure of the discharge stream from the first gas decomposition furnace at the outlet of the first gas decomposition furnace and a pressure of the upper discharge stream from the second quench tower at the inlet of the compressor is 0.26 bar or less.

9. The method of claim 6, wherein a differential pressure between a pressure of the discharge stream from the second gas decomposition furnace at the outlet of the second gas decomposition furnace and a pressure of the upper discharge stream from the second quench tower at the inlet of the compressor is 0.26 bar or less.

* * * * *